US009494963B2

(12) United States Patent
Li

(10) Patent No.: US 9,494,963 B2
(45) Date of Patent: Nov. 15, 2016

(54) MULTI-STAGE VOLTAGE DIVISION CIRCUIT

(71) Applicant: INTEGRATED SOLUTIONS TECHNOLOGY INC., Taipei (TW)

(72) Inventor: Jie Li, Guangdong (CN)

(73) Assignee: INTEGRATED SOLUTIONS TECHNOLOGY INC., Taipei (TW)

( * ) Notice: Subject to any disclaimer, the term of this patent is extended or adjusted under 35 U.S.C. 154(b) by 98 days.

(21) Appl. No.: 14/515,569

(22) Filed: Oct. 16, 2014

(65) Prior Publication Data

US 2016/0085254 A1 Mar. 24, 2016

(30) Foreign Application Priority Data

Sep. 22, 2014 (CN) ..... 2014 1 0487877

(51) Int. Cl.
*H03L 5/00* (2006.01)
*G05F 3/02* (2006.01)

(52) U.S. Cl.
CPC ..... *G05F 3/02* (2013.01)

(58) Field of Classification Search
CPC ..... H03L 5/00
See application file for complete search history.

(56) References Cited

U.S. PATENT DOCUMENTS 5,781,001 A * 7/1998 Takemoto ..... G09G 3/3696 323/267
6,147,549 A * 11/2000 Ohno ..... G05F 1/56 323/313
6,229,379 B1 * 5/2001 Okamoto ..... H02M 3/07 327/535
7,064,529 B2 6/2006 Telecco
7,567,116 B2 7/2009 Yoshio
2009/0072800 A1 3/2009 Ramadass et al.
2012/0293254 A1 11/2012 Hui et al.

FOREIGN PATENT DOCUMENTS

| | | | |
|---|---|---|---|
| CN | 1140050 | C | 2/2004 |
| CN | 1160861 | C | 8/2004 |
| CN | 101322088 | A | 12/2008 |
| CN | 102739040 | A | 10/2012 |
| CN | 103488234 | A | 1/2014 |
| TW | 200601000 | | 1/2006 |
| TW | M449980 | U1 | 4/2013 |

* cited by examiner

*Primary Examiner* — Hai L Nguyen
(74) *Attorney, Agent, or Firm* — Li & Cai Intellectual Property (USA) Office

(57) ABSTRACT

A multi-stage voltage division circuit is provided and includes a main-stage voltage division element and a sub-stage voltage division element. The main-stage voltage division element is connected between a high-voltage end and a low-voltage end to average a high voltage and a low voltage and accordingly generates a main output voltage. The sub-stage voltage division element is connected between the high-voltage end and the low-voltage end and connected in parallel with the main-stage voltage division element. The sub-stage voltage division element averages the main output voltage and the low voltage to generate a lower output voltage. The sub-stage voltage division element averages the high voltage and the main output voltage to generate an upper output voltage. Therefore, in the situation of generating the same amount of divided voltages, the multi-stage voltage division circuit has higher driving efficiency and generates stable divided voltages to loads.

10 Claims, 6 Drawing Sheets

MULTI-STAGE VOLTAGE DIVISION CIRCUIT

BACKGROUND

1. Technical Field

The present invention relates to a voltage division circuit, in particular, to a multi-stage voltage division circuit having voltage division elements connected in parallel with each other.

2. Description of Related Art

In integrated circuits, voltage division circuits are used for generating different voltages to loads, so as to drive the loads or providing for loads doing other applications.

The traditional voltage division circuit is configured for voltage division elements connected in series in the same current path to generate divided voltages accordingly. The following regards the voltage division element as the resistor, as shown in FIG. 1. The voltage division circuit 10 is configured for four resistors R1, R2, R3, and R4, which are connected in series in a current path IC. The resistors R1~R4 have the same resistance value. One end of the voltage division circuit 10 receives the voltage VC and another end connects to ground. Therefore, the voltage division circuit 10 respectively generates the divided voltages B1, B2, and B3 among the resistors R1~R4 according to the resistance value of the resistors R1~R4. Meanwhile, the voltages Vn of the divided voltages B1, B2, and B3 are defined by Vn=n/4*VC, wherein n is an integer from 1~3. The input powers Pn of the divided voltages B1, B2, and B3 are defined by Pn=Vn*IC, wherein n is an integer from 1~3.

However, the higher driving capability each divided voltage B1~B3 has, the greater static power the voltage division circuit 10 has. Moreover, each divided voltage B1~B3 has power consumption calculated by Pn=Vn*IC, causing lower driving efficiency of the voltage division circuit 10. In addition, the relation among the divided voltages B1~B3 is higher in the structure of the resistors connected in series. When the load connected to one divided voltage is changed, the other divided voltages may also be affected by the changed load, causing worse stability of the divided voltages B1~B3. Therefore, if the abovementioned drawback may be improved, the voltage division circuit 10 may generate more stable divided voltages B1~B3 to the corresponding loads.

To address the above issues, the inventor strives via associated experience and research to present the instant disclosure, which can effectively improve the limitation described above.

SUMMARY

Accordingly, an objective of the instant disclosure is to provide a multi-stage voltage division circuit, which configures voltage division elements by the multi-stage structure. Therefore, in the situation of generating the same amount of divided voltages, the multi-stage voltage division circuit has higher driving efficiency and generates stable divided voltages to loads.

An exemplary embodiment of the instant disclosure provides a multi-stage voltage division circuit. The multi-stage voltage division circuit includes a high-voltage end, a low-voltage end, a main-stage voltage division element, and a sub-stage voltage division element. The high-voltage end is configured for generating a high voltage. The low-voltage end is configured for generating a low voltage. The main-stage voltage division element is connected between the high-voltage end and the low-voltage end. The main-stage voltage division element has a main end. The main-stage voltage division element is configured for receiving and averaging the high voltage and the low voltage to generate a main output voltage to the main end, wherein a sum of the high voltage and the low voltage is twice that of the main output voltage. The sub-stage voltage division element is connected between the high-voltage end and the low-voltage end and is connected in parallel with the main-stage voltage division element. The sub-stage voltage division element has a lower end and an upper end. The sub-stage voltage division element is configured for receiving and averaging the main output voltage and the low voltage to generate a lower output voltage to the lower end, wherein a sum of the main output voltage and the low voltage is twice that of the lower output voltage. The sub-stage voltage division element is also configured for receiving and averaging the high voltage and the main output voltage to generate an upper output voltage to the upper end, wherein a sum of the high voltage and the main output voltage is twice that of the upper output voltage.

To sum up, the multi-stage voltage division circuit averages the received voltages in each stage to generate $2^N-1$ divided voltages (N is a number of the stage and N≥1) according to the number of the stages. Therefore, in the situation of generating the same amount of divided voltages, the multi-stage voltage division circuit has higher driving efficiency. Additionally, the relation among the divided voltages is lower in the multi-stage structure. When the load connected to one divided voltage is changed, the other divided voltages have lower influence, causing better stability of the divided voltages. Therefore, the voltage division circuit generates more stable divided voltages to the corresponding loads.

In order to further understand the techniques, means and effects of the present invention, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present invention.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain the principles of the present invention.

DESCRIPTION OF THE EXEMPLARY EMBODIMENTS

Figure 1:
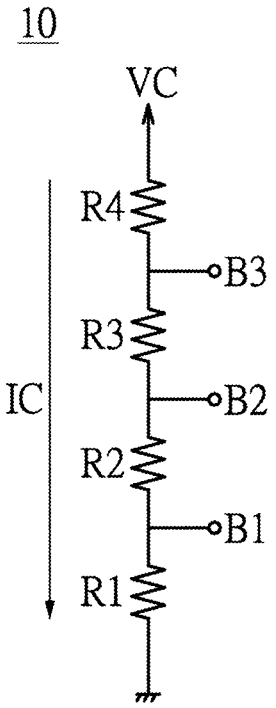
FIG.1 PRIOR ART
FIG. 1 is a block diagram of a traditional voltage division circuit.

Reference will now be made in detail to the exemplary embodiments of the present disclosure, examples of which are illustrated in the accompanying drawings. However, they may be embodied in different forms and should not be construed as being limited to the embodiments set forth herein. Wherever possible, the same reference numbers are used in the drawings and the description to refer to the same or like parts.

Figure 2A:
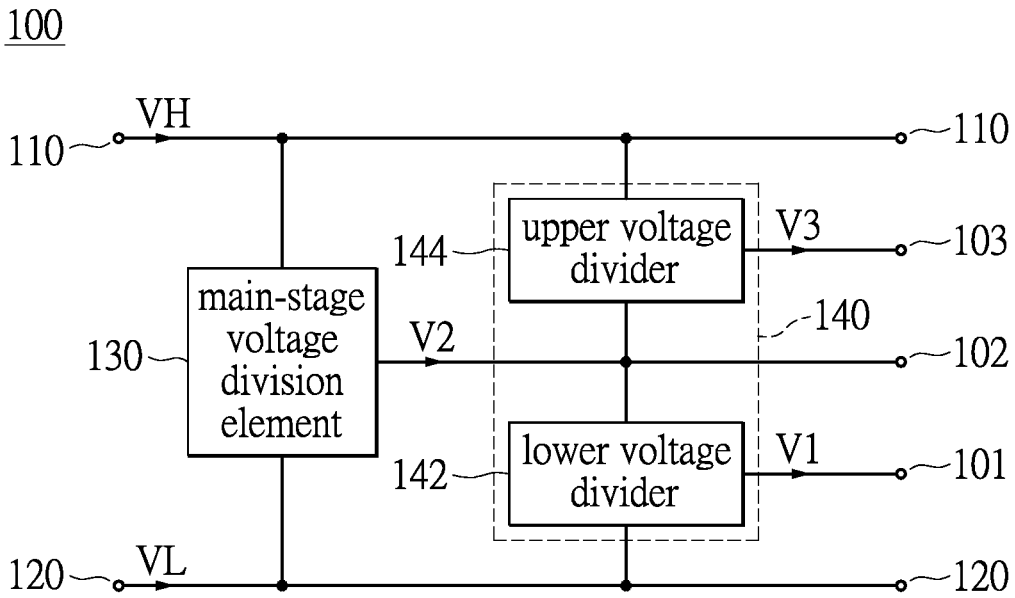
FIG. 2A is a block diagram of a multi-stage voltage division circuit according to an exemplary embodiment of the instant disclosure.

Firstly, please refer to FIG. 2A, which shows a block diagram of a multi-stage voltage division circuit according to an exemplary embodiment of the instant disclosure. As shown in FIG. 2A, the multi-stage voltage division circuit 100 includes a high-voltage end 110, a low-voltage end 120, a main-stage voltage division element 130, and a sub-stage voltage division element 140. The high-voltage end 110 is configured for generating a high voltage VH. The low-voltage end 120 is configured for generating a low voltage VL. The main-stage voltage division element 130 electrically connects between the high-voltage end 110 and the low-voltage end 120 to receive the high voltage VH and the low voltage VL. The main-stage voltage division element 130 has a main end 102 and generates a main output voltage V2 to the main end 102 according to the high voltage VH and the low voltage VL. It is worth to note that the main-stage voltage division element 130 averages the high voltage VH and the low voltage VL to generate the main output voltage V2, i.e., V2=(VH+VL)/2. Meanwhile, the sum of the high voltage VH and the low voltage VL is twice that of the main output voltage V2.

Figure 2B:
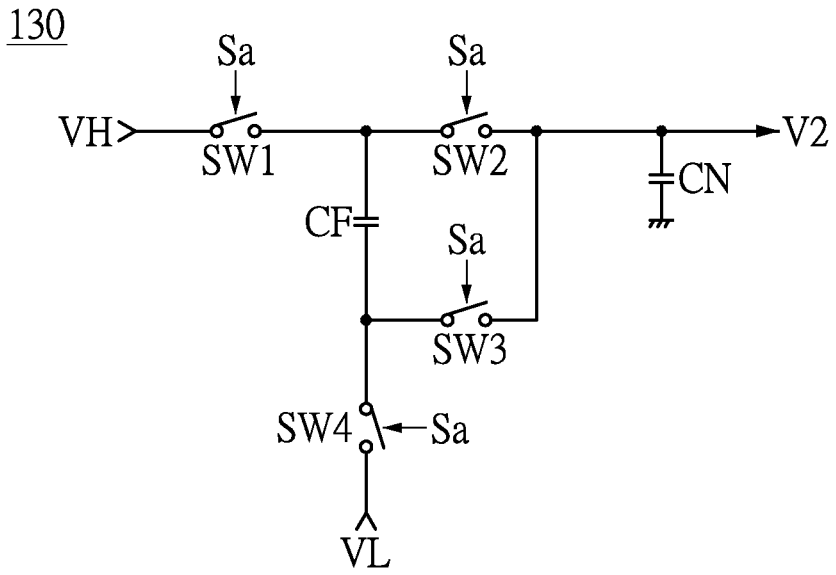
FIG. 2B is a block diagram of a main-stage voltage division element according to an exemplary embodiment of the instant disclosure.

In the instant disclosure, the main-stage voltage division element 130 is a voltage divider used for averaging the voltage. The main-stage voltage division element 130 is, but not limited to being, preferably made by a switching capacitor circuit. As shown in FIG. 2B, the main-stage voltage division element 130 includes a capacitor CF, a capacitor CN, and four switches SW1~SW4. One end of the switch SW1 receives the high voltage VH and another end of the switch SW1 electrically connects to one end of the switch SW2. Another end of the switch SW2 transmits the main output voltage V2. One end of the capacitor CF electrically connects between the said another end of the switch SW1 and the said end of the switch SW2. Another end of the capacitor CF electrically connects one end of the switch SW4. Another end of the switch SW4 receives the low voltage VL. One end of the switch SW3 electrically connects between the said another end of the capacitor CF and the said end of the switch SW4. Another end of the switch SW3 electrically connects to the said another end of the switch SW2. One end of the capacitor CN electrically connects the said another end of the switch SW2 and another end of the capacitor CN connects to ground. In the instant disclosure, the capacitor CF is used for storing energy of the high voltage VH and the low voltage VL. The capacitor CN is used for stabilizing the main output voltage V2, so as to reduce the ripple voltage.

The operation of the voltage divider is that the voltage divider controls the switches SW1, SW3 or the switches SW2, SW4 by a switch signal Sa. More specifically, when the switches SW1~SW4 receive the high-level switch signal Sa, the switches SW1, SW3 are turned on and the switches SW2, SW4 are turned off. When the switches SW1~SW4 receive the low-level switch signal Sa, the switches SW1, SW3 are turned off and the switches SW2, SW4 are turned on. Accordingly, the main-stage voltage division element 130 averages the high voltage VH and the low voltage VL by the control switches SW1~SW4 to generate the main output voltage V2. Meanwhile, the sum of the high voltage VH and the low voltage VL is twice that of the main output voltage V2, i.e., V2=(VH+VL)/2.

Please turn to FIG. 2A, the sub-stage voltage division element 140 electrically connects between the high-voltage end 110 and the low-voltage end 120 and connects in parallel with the main-stage voltage division element 130. Therefore, the main-stage voltage division element 130 and the sub-stage voltage division element 140 may average the high voltage VH and the low voltage VL in the situation of the same voltage level. The sub-stage voltage division element 140 has a lower end 101 and an upper end 103. Then the sub-stage voltage division element 140 generates a lower output voltage V1 to the lower end 101 according to the main output voltage V2 and the low voltage VL. The sub-stage voltage division element 140 also generates an upper output voltage V3 to the upper end 103 according to the high voltage VH and the main output voltage V2.

It is worth to note that the sub-stage voltage division element 140 averages the main output voltage V2 and the low voltage VL to generate the lower output voltage V1, i.e., V1=(V2+VL)/2. Meanwhile, the sum of the main output voltage V2 and the low voltage VL is twice that of the lower output voltage V1. Additionally, the sub-stage voltage division element 140 averages the high voltage VH and the main output voltage V2 to generate the upper output voltage V3, i.e., V3=(VH+V2)/2. Meanwhile, the sum of the high voltage VH and the main output voltage V2 is twice that of the upper output voltage V3.

In the instant disclosure, the sub-stage voltage division element 140 can be a lower voltage divider 142 and an upper voltage divider 144. One end of the lower voltage divider 142 electrically connects to the main end 102 and another end of the lower voltage divider 142 electrically connects to the low-voltage end 120. Therefore, the lower voltage divider 142 receives the main output voltage V2 and the low voltage VL to generate the lower output voltage V1 to the lower end 101. One end of the upper voltage divider 144 electrically connects to the high-voltage end 110 and another end of the upper voltage divider 144 electrically connects to the main end 102. Therefore, the upper voltage divider 144 receives the high-voltage end VH and the main output voltage V2 to generate the upper output voltage V3 to the upper end 103. In the instant disclosure, the lower voltage divider 142 and the upper voltage divider 144 are used for averaging the voltage. Preferably, the lower voltage divider 142 and the upper voltage divider 144 are made by a switching capacitor circuit. With respect to internal components and operations, the lower voltage divider 142 and the upper voltage divider 144 are the same as that of the main-stage voltage division element 130, so detailed description is omitted. Accordingly, the lower voltage divider 142 averages the main output voltage V2 and the low voltage VL based on the control switch. The upper voltage divider 144 averages the high voltage VH and the main output voltage V2 based on the control switch.

It is worth to note that the main-stage voltage division element 130, the lower voltage divider 142, and the upper voltage divider 144 are designed with the switching capacitor circuit. Compared to a traditional voltage division circuit 10 (i.e., the resistors connected in series), the multi-stage voltage division circuit 100, because the capacitor does not cause power consumption and the switches cause less power consumption in operation, has higher driving efficiency.

The lower output voltage V1, the main output voltage V2, and the upper output voltage V3 of the above-mentioned descriptions will be arranged and shown in the following Table 1.

TABLE 1

| | |
|---|---|
| Upper output voltage | $V3 = (VH - V2)/2 = 3*(VH - VL)/2^2 + VL$ |
| Main output voltage | $V2 = (VH + VL)/2 = 2*(VH - VL)/2^2 + VL$ |
| Lower output voltage | $V1 = (V2 + VL)/2 = 1*(VH - VL)/2^2 + VL$ |

As shown in Table 1, the multi-stage voltage division circuit 100 averages the received voltages in two stages (i.e., the main-stage voltage division element 130 and the sub-stage voltage division element 140) to generate $2^2-1$ divided voltages (i.e., the lower output voltage V1, the main output voltage V2, and the upper output voltage V3) according to number of stages (i.e., two stages). Each divided voltage Vm is defined by $Vm=m*(VH-VL)/2^2+VL$, wherein m is an integer from $1\sim2^2-1$.

According to the divided voltage Vm, the input power Pm of each divided voltage Vm is defined by Pm=Vm*(IVH/m), wherein IVH is the current flowing through the main-stage voltage division element 130, and m is an integer from $1\sim2^2-1$. According to the traditional voltage division circuit 10 of FIG. 1, the input power Pn of each divided voltage is defined by Pn=Vn*IC, wherein n is an integer from 1~3. Compare the traditional voltage division circuit 10 with the multi-stage voltage division circuit 100, when the high voltage VH and the voltage VC are the same, and the low voltage VL is 0. The input power Pm of each divided voltage of the multi-stage voltage division circuit 100 is lower than the input power Pn of each divided voltage of the voltage division circuit 10 in FIG. 1, so that the multi-stage voltage division circuit 100 has higher driving efficiency.

Because the divided voltages of the multi-stage voltage division circuit 100 are generated separately, the relation among the divided voltages is lower. Thus, when the load connected to one divided voltage (e.g., the lower output voltage V1) is changed, the other divided voltages (e.g., the main output voltage V2 and the upper output voltage V3) have lower influence, causing the better stability of each divided voltage. Therefore, the multi-stage voltage division circuit 100 generates more stable divided voltages to the corresponding loads.

Figure 3A:
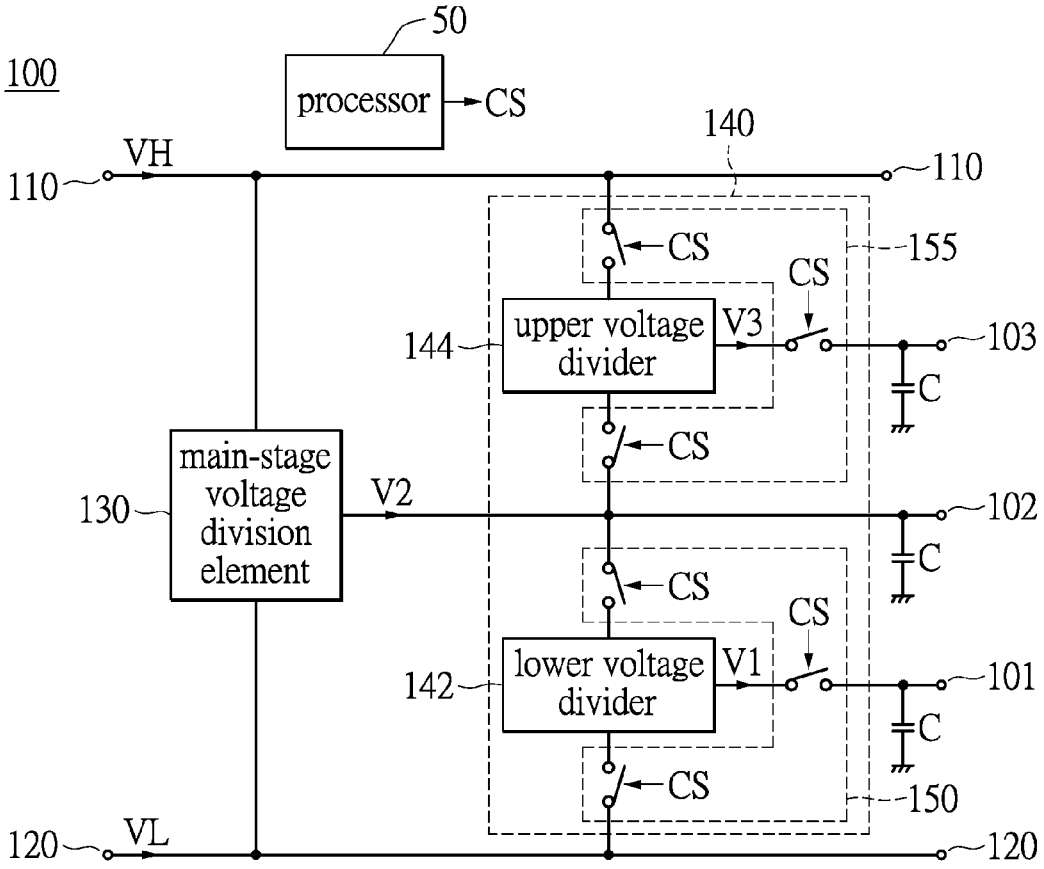
FIG. 3A is a block diagram of a multi-stage voltage division circuit according to another exemplary embodiment of the instant disclosure.

Please refer to FIG. 3A, the multi-stage voltage division circuit 100 further includes three capacitors C. One end of the three capacitors C respectively connects to the lower end 101, the main end 102, and the upper end 103. Another end of the three capacitors C connects to ground. Thus, the lower end 101, the main end 102, and the upper end 103 may respectively and stably output the lower output voltage V1, the main output voltage V2, and the upper output voltage V3 to reduce ripple voltage. Besides, when the main-stage voltage division element 130 and the lower voltage divider 142 and the upper voltage divider 144 of the sub-stage voltage division element 140 are configured with the capacitor CN as shown in FIG. 2B, the three capacitors C can be omitted. The instant disclosure is not limited thereto.

Besides, as shown in FIG. 3A, the sub-stage voltage division element 140 further includes a lower switch set 150 and an upper switch set 155. The lower switch set 150 electrically connects the two ends of the lower voltage divider 142 and the lower end 101. The upper switch set 155 electrically connects the two ends of the upper voltage divider 144 and the upper end 103. The lower switch set 150 and the upper switch set 155 are controlled by a control signal CS. More specifically, the lower switch set 150 and the upper switch set 155 have three switches respectively. The three switches of the lower switch set 150 respectively connect to the two ends of the lower voltage divider 142 and the lower end 101. The three switches of the upper switch set 155 respectively connect to the two ends of the upper voltage divider 144 and the upper end 103.

Figure 3B:
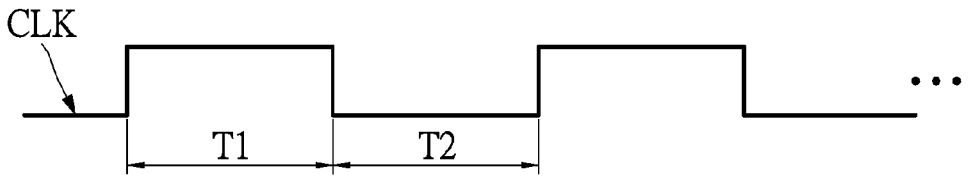
FIG. 3B is a waveform diagram of a first clock of FIG. 3A.

In the instant disclosure, the control signal CS is generated by an external processor 50. The control signal CS can also be generated by the sub-stage voltage division element 140. The instant disclosure is not limited thereto. As shown in FIG. 3B, the processor 50 has a first clock CLK. In the instant disclosure, the first clock CLK periodically generates a first time T1 and a second time T2. Therefore, when the first clock CLK is high level (i.e., the first time T1), the processor 50 controls the control signal CS to turn-on the lower switch set 150 and turn-off the upper switch set 155. Meanwhile, the lower voltage divider 142 generates the lower output voltage V1 and the upper voltage divider 144 does not generate the upper output voltage V3. When the first clock CLK is low level (i.e., the second time T2), the processor 50 controls the control signal CS to turn-off the lower switch set 150 and turn-on the upper switch set 155. Meanwhile, the lower voltage divider 142 does not generate the lower output voltage V1 and the upper voltage divider 144 generates the upper output voltage V3. Accordingly, the lower voltage divider 142 and the upper voltage divider 144 may output the lower output voltage V1 and the upper output voltage V3 to the corresponding lower end 101 and upper end 102 at different times.

It is worth to note that the multi-stage voltage division circuit 100 may also control the sub-stage voltage division element 140 to generate the lower output voltage V1 and the upper output voltage V3 by a Time-Division Multiplexing (TDM) method. Meanwhile, the sub-stage voltage division element 140 only uses one voltage divider to replace the lower voltage divider 142 and the upper voltage divider 144 and then generates the lower output voltage V1 and the upper output voltage V3. The specific implementation method is that one voltage divider connects to the lower end 101 through a lower switch and connects to the upper end 102 through an upper switch. The upper switch and the lower switch are controlled by the control signal CS (not shown in FIGs). Therefore, when the first clock CLK is high level (i.e., the first time T1), the processor 50 controls the control signal CS to turn-on the lower switch and turn-off the upper switch. Meanwhile, one voltage divider generates the lower output voltage V1 and does not generate the upper output voltage V3 accordingly. When the first clock CLK is low level (i.e., the second time T2), the processor 50 controls the control signal CS to turn-off the lower switch and turn-on the upper switch. Meanwhile, one voltage divider generates the upper output voltage V3 and does not generate the lower output voltage V1 accordingly. Therefore, the multi-stage voltage division circuit 100 may reduce the number of the voltage dividers.

Figure 4:
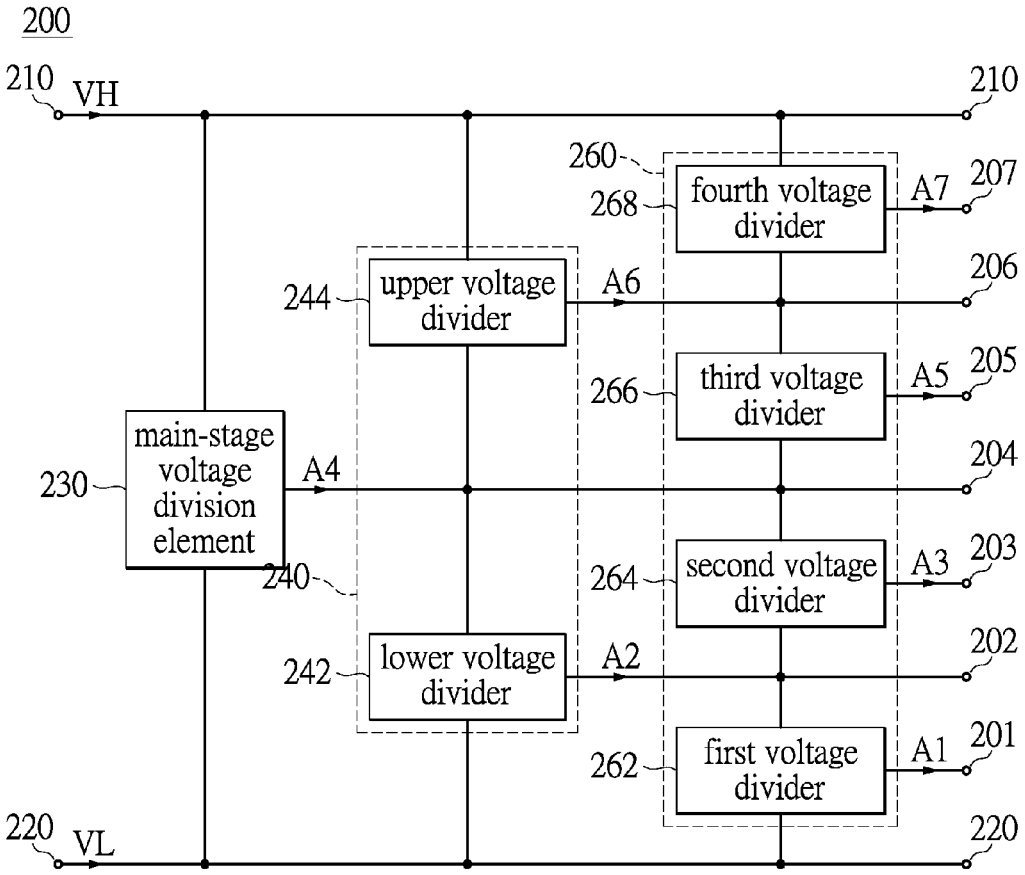
FIG. 4 is a block diagram of a multi-stage voltage division circuit according to another exemplary embodiment of the instant disclosure.

Please refer to FIG. 4, which shows a block diagram of a multi-stage voltage division circuit according to another exemplary embodiment of the instant disclosure. The multi-stage voltage division circuit 200 includes a high-voltage end 210, a low-voltage end 220, a main-stage voltage division element 230, a sub-stage voltage division element 240, and a next-stage voltage division element 260. The connection relationships and operations among the high-voltage end 210, the low-voltage end 220, the main-stage voltage division element 230, and the sub-stage voltage division element 240 are the same as that of the high-voltage end 110, the low-voltage end 120, the main-stage voltage division element 130, and the sub-stage voltage division element 140 as shown in FIG. 2A, so their detailed description is omitted. Besides, a lower output voltage A2 of a lower end 202, a main output voltage A4 of a main end 204, and an upper output voltage A6 of an upper end 206 are the same as the lower output voltage V1 of a lower end 101, the main output voltage V2 of the main end 102, and the upper output voltage V3 of the upper end 103, so their detailed description is omitted.

The difference is that the multi-stage voltage division circuit 200 has the next-stage voltage division element 260. The next-stage voltage division element 260 connects between the high-voltage end 210 and the low-voltage end 220 and connects in series with the main-stage voltage division element 230. Therefore, the main-stage voltage division element 230, the sub-stage voltage division element 230, and the next-stage voltage division element 260 can average the high voltage VH and the low voltage VL in the situation of the same voltage level. The next-stage voltage division element 260 has a first end 201, a second end 203, a third end 205, and a fourth end 207. The next-stage voltage division element 260 generates a first output voltage A1 to the first end 201 according to the lower output voltage A1 and the low voltage VL. The next-stage voltage division element 260 generates a second output voltage A3 to the second end 203 according to the main output voltage A4 and the lower output voltage A2. The next-stage voltage division element 260 generates a third output voltage A5 to the third end 205 according to the upper output voltage A6 and the main output voltage A4. The next-stage voltage division element 260 generates a fourth output voltage A7 to the fourth end 207 according to the high voltage VH and the upper output voltage A6.

It is worth to note that the next-stage voltage division element 260 averages the lower output voltage A2 and the low voltage VL to generate the first output voltage A1, i.e., A1=(A2+VL)/2. Meanwhile, the sum of the lower output voltage A2 and the low voltage VL is twice that of the first output voltage A1. Furthermore, the next-stage voltage division element 260 averages the main output voltage A4 and the lower output voltage A2 to generate the second output voltage A3, i.e., A3=(A4+A2)/2. Meanwhile, the sum of the main output voltage A4 and the lower output voltage A2 is twice that of the second output voltage A3. Furthermore, the next-stage voltage division element 260 averages the upper output voltage A6 and the main output voltage A4 to generate the third output voltage A5, i.e., A5=(A6+A4)/2. Meanwhile, the sum of the upper output voltage A6 and the main output voltage A4 is twice that of the third output voltage A5. Besides, the next-stage voltage division element 260 averages the high voltage VH and the upper output voltage A6 to generate the fourth output voltage A7, i.e., A7=(VH+A6)/2. Meanwhile, the sum of the high voltage VH and the upper output voltage A6 is twice that of the fourth output voltage A7.

In the instant disclosure, the next-stage voltage division element 260 can be a first voltage divider 262, a second voltage divider 264, a third voltage divider 266, and a fourth voltage divider 268. One end of the first voltage divider 262 electrically connects to the lower end 202, and another end electrically connects to the low-voltage end 220. Therefore, the first voltage divider 262 generates the first output voltage A1 to the first end 201 according to the lower output voltage A2 and the low voltage VL. One end of the second voltage divider 264 electrically connects to the main end 204, and another end electrically connects to the lower end 202. Therefore, the second voltage divider 264 generates the second output voltage A3 to the second end 203 according to the main output voltage A4 and the lower output voltage A2. One end of the third voltage divider 266 electrically connects to the upper end 206, and another end electrically connects to the main end 204. Therefore, the third voltage divider 266 generates the third output voltage A5 to the third end 205 according to the upper output voltage A6 and the main output voltage A4. One end of the fourth voltage divider 268 electrically connects to the high-voltage end 210, and another end of that electrically connects the upper end 206. Therefore, the fourth voltage divider 268 generates the fourth output voltage A7 to the fourth end 207 according to the high voltage VH and the upper output voltage A6. In the instant disclosure, the first voltage divider 262, the second voltage divider 264, the third voltage divider 266, and the fourth voltage divider 268 are used for averaging the voltage. Preferably, the abovementioned voltage dividers are made by switching capacitor circuits. With respect to internal components and operations, the first voltage divider 262, the second voltage divider 264, the third voltage divider 266, and the fourth voltage divider 268 are the same as that of the main-stage voltage division element 130 in FIG. 2B, so detailed description is omitted.

The first output voltage A1, the lower output voltage A2, the second output voltage A3, the main output voltage A4, the third output voltage A5, the upper output voltage A6, and the fourth output voltage A7 of the above-mentioned description will be arranged and shown in the following Table 2.

TABLE 2

| | |
|---|---|
| fourth output voltage | A7 = (VH + A6)/2 = 7*(VH − VL)/23 + VL |
| upper output voltage | A6 = (VH − A4)/2 = 6*(VH − VL)/23 + VL |
| third output voltage | A5 = (A6 + A4)/2 = 5*(VH − VL)/23 + VL |
| main output voltage | A4 = (VH + VL)/2 = 4*(VH − VL)/23 + VL |
| second output voltage | A3 = (A4 + A2)/2 = 3*(VH − VL)/23 + VL |
| lower output voltage | A2 = (A4 + VL)/2 = 2*(VH − VL)/23 + VL |
| first output voltage | A1 = (A2 + VL)/2 = 1*(VH − VL)/23 + VL |

As shown in Table 2, the multi-stage voltage division circuit 200 averages the received voltages in three stages (i.e., the main-stage voltage division element 230, the sub-stage voltage division element 240, and the next-stage voltage division element 260) to generate $2^3-1$ divided voltages (i.e., the first output voltage A1, the lower output voltage A2, the second output voltage A3, the main output voltage A4, the third output voltage A5, the upper output voltage A6, and the fourth output voltage A7) according to the number of stages (i.e., three stages). Each divided voltage Vm is defined by $Vm=m*(VH-VL)/2^3+VL$, wherein m is an integer from $1\sim2^3-1$. Similarly, according to the divided voltage Vm, the input power Pm of each divided voltage Vm is defined by Pm=Vm*(IVH/m), wherein IVH is the current flowing through the main-stage voltage division element 230, and m is an integer from $1\sim2^3-1$. Compared to the traditional voltage division circuit 10 in FIG. 1, the multi-stage voltage division circuit 200 has higher driving efficiency.

Because the divided voltages of the multi-stage voltage division circuit 200 are generated separately, the relation among the divided voltages is lower. Thus, when the load connected to one divided voltage (e.g., the voltage A1) is changed, the other divided voltages (e.g., the voltages A2~A7) have lower influence, causing better stability of each divided voltage. Therefore, the multi-stage voltage division circuit 200 may generate more stable divided voltages to the corresponding loads.

Figure 5A:
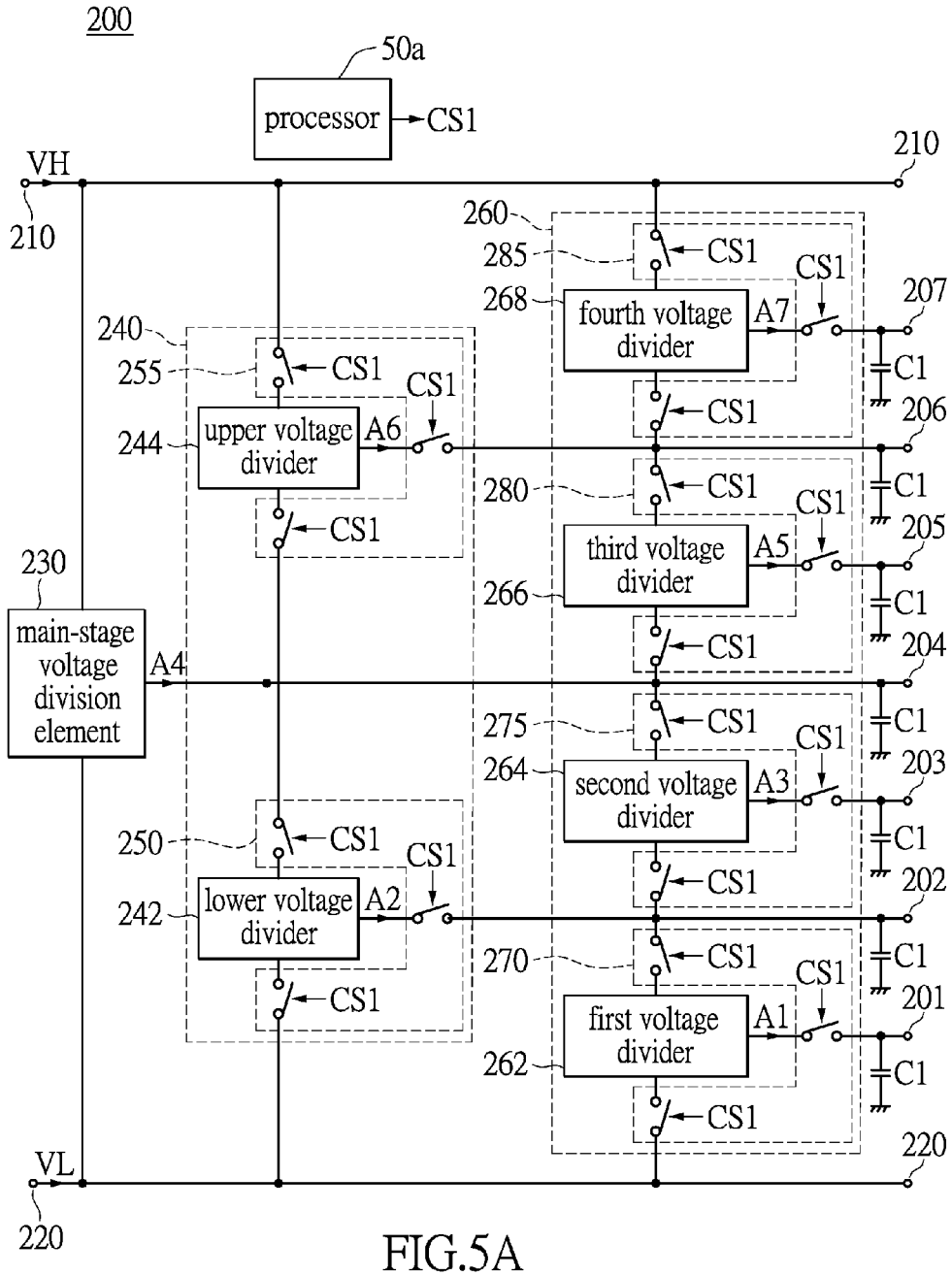
FIG. 5A is a block diagram of a multi-stage voltage division circuit according to another exemplary embodiment of the instant disclosure.

Please refer to FIG. 5A, the multi-stage voltage division circuit 200 further includes seven capacitors C1. One end of the seven capacitors C1 respectively connects to the first end 201, the lower end 202, the second end 203, the main end 204, the third end 205, the upper end 206, and the fourth end 207. Another end of the seven capacitors C1 connects to ground. Thus, the first end 201, the lower end 202, the second end 203, the main end 204, the third end 205, the upper end 206, and the fourth end 207 may respectively and stably output the first output voltage A1, the lower output voltage A2, the second output voltage A3, the main output voltage A4, the third output voltage A5, the upper output voltage A6, and the fourth output voltage A7, to reduce ripple voltage. Besides, when the main-stage voltage division element 230, the lower voltage divider 242 and the upper voltage divider 244 of the sub-stage voltage division element 240, and the first voltage divider 262, the second voltage divider 264, the third voltage divider 266, and the fourth voltage divider 266 of the next-stage voltage division element 260 are configured with the capacitor CN as shown in FIG. 2B, the seven capacitors C1 can be omitted. The instant disclosure is not limited thereto.

Besides, as shown in FIG. 5A, the sub-stage voltage division element 240 further includes a lower switch set 250 and an upper switch set 255. The lower switch set 250 electrically connects the two ends of the lower voltage divider 242 and the lower end 202. The upper switch set 255 electrically connects the two ends of the upper voltage divider 244 and the upper end 206. The lower switch set 250 and the upper switch set 255 are controlled by a control signal CS1. The next-stage voltage division element 260 further includes a first switch set 270, a second switch set 275, a third switch set 280, and a fourth switch set 285. The first switch set 270 electrically connects the two ends of the first voltage divider 262 and the first end 201. The second switch set 275 electrically connects the two ends of the second voltage divider 264 and the second end 203. The third switch set 280 electrically connects the two ends of the third voltage divider 266 and the third end 205. The fourth switch set 285 electrically connects the two ends of the third voltage divider 268 and the fourth end 207. The first switch set 270, the second switch set 275, the third switch set 280, and the fourth switch set 285 are controlled by a control signal CS1.

More specifically, the lower switch set 250, the upper switch set 255, the first switch set 270, the second switch set 275, the third switch set 280, and the fourth switch set 285 have three switches respectively. The three switches of the lower switch set 250 respectively connect to the two ends of the lower voltage divider 242 and the lower end 202. The three switches of the upper switch set 255 respectively connect to the two ends of the upper voltage divider 244 and the upper end 206. The three switches of the first switch set 270 respectively connect to the two ends of the first voltage divider 262 and the first end 201. The three switches of the second switch set 275 respectively connect to the two ends of the second voltage divider 264 and the second end 203. The three switches of the third switch set 280 respectively connect to the two ends of the third voltage divider 266 and the third end 205. The three switches of the fourth switch set 285 respectively connect to the two ends of the fourth voltage divider 268 and the fourth end 207.

In the instant disclosure, the control signal CS1 is generated by an external processor 50*a*. The control signal CS1 can also be generated by the sub-stage voltage division element 240 and the next-stage voltage division element 260. The instant disclosure is not limited thereto.

Figure 5B:
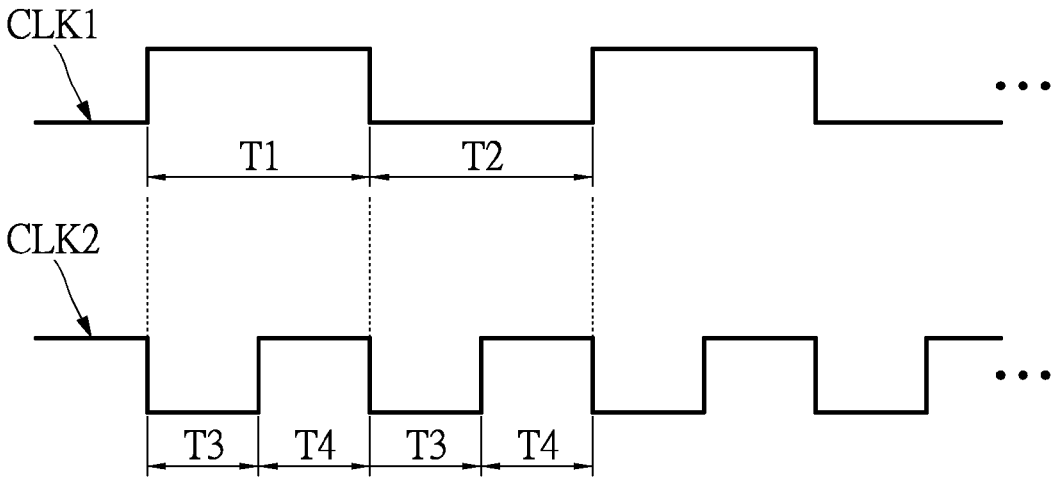
FIG. 5B is a waveform diagram of a first clock and a second clock of FIG. 5A.

As shown in FIG. 5B, the processor 50*a* has a first clock CLK1 and a second clock CLK2. In the instant disclosure, the first clock CLK1 periodically generates a first time T1 and a second time T2. The second clock CLK2 periodically generates a third time T3 and a fourth time T4.

Therefore, when the first clock CLK1 is high level (i.e., the first time T1) and the second clock CLK2 is low level (i.e., the third time T3), the processor 50*a* controls the control signal CS1 to turn-on the lower switch set 250 and the first switch set 270, and turn-off the upper switch set 255, the second switch set 275, the third switch set 280, and the fourth switch set 285. Meanwhile, the lower voltage divider 242 generates the lower output voltage A2 and the first voltage divider 262 generates the first output voltage A1.

When the first clock CLK1 is high level (i.e., the first time T1) and the second clock CLK2 is high level (i.e., the fourth time T4), the processor 50*a* controls the control signal CS1 to turn-on the lower switch set 250 and the second switch set 275, and turn-off the upper switch set 255, the first switch set 270, the third switch set 280, and the fourth switch set 285. Meanwhile, the lower voltage divider 242 generates the lower output voltage A2 and the second voltage divider 264 generates the second output voltage A3.

When the first clock CLK1 is low level (i.e., the second time T2) and the second clock CLK2 is low level (i.e., the third time T3), the processor 50*a* controls the control signal CS1 to turn-on the upper switch set 255 and the third switch set 280, and turn-off the lower switch set 250, the first switch set 270, the second switch set 275, and the fourth switch set 285. Meanwhile, the upper voltage divider 244 generates the upper output voltage A6 and the third voltage divider 266 generates the third output voltage A5.

When the first clock CLK1 is low level (i.e., the second time T2) and the second clock CLK2 is high level (i.e., the fourth time T4), the processor 50*a* controls the control signal CS1 to turn-on the upper switch set 255 and the fourth switch set 285, and turn-off the lower switch set 250, the first switch set 270, the second switch set 275, and the third switch set 280. Meanwhile, the upper voltage divider 244 generates the upper output voltage A6 and the fourth voltage divider 268 generates the fourth output voltage A7.

Accordingly, the first voltage divider 262, the lower voltage divider 242, the second voltage divider 264, the third voltage divider 266, the upper voltage divider 244, and the fourth voltage divider 268 can output the first output voltage A1, the lower output voltage A2, the second output voltage A3, the third output voltage A5, the upper output voltage A6, and the fourth output voltage A7 to the corresponding first end 201, lower end 202, second end 203, third end 205, upper end 206, and fourth end 207 at different times.

It is worth to note that the multi-stage voltage division circuit 200 may also control the sub-stage voltage division element 240 to generate the lower output voltage A2 and the upper output voltage A6, and control the next-stage voltage division element 260 to generate the first output voltage A1, the second output voltage A3, the third output voltage A5, and the fourth output voltage A7 by a Time-Division Multiplexing (TDM) method.

Meanwhile, the sub-stage voltage division element 240 only uses one voltage divider to replace the lower voltage divider 242 and the upper voltage divider 244 and then generates the lower output voltage A2 and the upper output voltage A6. The next-stage voltage division element 260 only uses one voltage divider to replace the first voltage divider 262, the second voltage divider 264, the third voltage divider 266, and the fourth voltage divider 268, and then generates the first output voltage A1, the second output voltage A3, the third output voltage A5, and the fourth output voltage A7.

The specific implementation method is described as follows. One voltage divider indicating the sub-stage voltage division element 240 connects to the lower end 202 through a lower switch and connects to the upper end 206 through an upper switch. The upper switch and the lower switch are controlled by the control signal CS1 (not shown in FIGs). One voltage divider indicating the next-stage voltage division element 260 connects to the first end 201 through a first switch, connects to the second end 203 through a second switch, connects to the third end 205 through a third switch, and connects to the fourth end 207 through a fourth switch. The first switch, the second switch, the third switch, and the fourth switch are controlled by the control signal CS1 (not shown in FIGs). The processor 50*a* operating in the first clock and the second clock in FIG. 5A is illustrated in the above description, and is the same as the processor 50*a* operating in the first clock in FIG. 3A, so their detailed description is omitted. Therefore, the multi-stage voltage division circuit 200 can reduce the number of the voltage dividers.

According to the multi-stage voltage division circuits in FIGS. 2A, 3A, 4, and 5A, when the multi-stage voltage division circuit is extended to the structure of N-stages (i.e., N voltage division elements connected in parallel with each other). The multi-stage voltage division circuit generates $2^N-1$ divided voltages according to number of stages (i.e., N-stages). Each divided voltage Vm is defined by $Vm=m*(VH-VL)/2^N+VL$, wherein $N\geq1$ and m is an integer from $1\sim2^N-1$. The input power Pm of each divided voltage Vm is defined by $Pm=Vm*(IVH/m)$, wherein IVH is the current flowing through the main-stage voltage division element, and m is an integer from $1\sim2^N-1$.

In summary, the multi-stage voltage division circuit averages the received voltages in each stage to generate $2^N-1$ divided voltages (N is a number of the stage and $N\geq1$) according to the number of the stage. Therefore, in the situation of generating the same amount of divided voltages, the multi-stage voltage division circuit has higher driving efficiency and generates more stable divided voltages to the corresponding loads.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. A multi-stage voltage division circuit, comprising:

a high-voltage end, configured for generating a high voltage;

a low-voltage end, configured for generating a low voltage;

a main-stage voltage division element, connected between the high-voltage end and the low-voltage end, the main-stage voltage division element having a main end, configured for receiving and averaging the high voltage and the low voltage to generate a main output voltage to the main end; and a sub-stage voltage division element, connected between the high-voltage end and the low-voltage end and connected in parallel with the main-stage voltage division element, the sub-stage voltage division element having a lower end and an upper end, configured for receiving and averaging the main output voltage and the low voltage to generate a lower output voltage to the lower end, and configured for receiving and averaging the high voltage and the main output voltage to generate an upper output voltage to the upper end;

wherein a sum of the high voltage and the low voltage is twice that of the main output voltage, a sum of the main output voltage and the low voltage is twice that of the lower output voltage, and a sum of the high voltage and the main output voltage is twice that of the upper output voltage;

wherein there are at least one switch and at least one capacitor but no resistors in the main-stage voltage division element and the sub-stage voltage division element.

2. The multi-stage voltage division circuit according to claim 1, further comprising a next-stage voltage division element connected between the high-voltage end and the low-voltage end and connected in parallel with the main-stage voltage division element, the next-stage voltage division element having a first end, a second end, a third end, and a fourth end;

wherein the next-stage voltage division element is configured for receiving and averaging the lower output voltage and the low voltage to generate a first output voltage to the first end, and a sum of the lower output voltage and the low voltage is twice that of the first output voltage;

wherein the next-stage voltage division element is configured for receiving and averaging the main output voltage and the lower output voltage to generate a second output voltage to the second end, and a sum of the main output voltage and the lower output voltage is twice that of the second output voltage;

wherein the next-stage voltage division element is configured for receiving and averaging the upper output voltage and the main output voltage to generate a third output voltage to the third end, and a sum of the upper output voltage and the main output voltage is twice that of the third output voltage; and wherein the next-stage voltage division element is configured for receiving and averaging the high voltage and the upper output voltage to generate a fourth output voltage to the fourth end, and a sum of the high voltage and the upper output voltage is twice that of the fourth output voltage.

3. The multi-stage voltage division circuit according to claim 2, further comprising four capacitors, one end of the four capacitors respectively connected to the first end, the second end, the third end, and the fourth end, and another end of the four capacitors connected to ground.

4. The multi-stage voltage division circuit according to claim 2, wherein the next-stage voltage division element comprises:

a first voltage divider, one end of the first voltage divider connected to the lower end, another end of the first voltage divider connected to the low-voltage end, and the first voltage divider generating the first output voltage to the first end according to the lower output voltage and the low voltage;

a second voltage divider, one end of the second voltage divider connected to the main end, another end of the second voltage divider connected to the lower end, and the second voltage divider generating the second output voltage to the second end according to the main output voltage and the lower output voltage;

a third voltage divider, one end of the third voltage divider connected to the upper end, another end of the third voltage divider connected to the main end, and the third voltage divider generating the third output voltage to the third end according to the upper output voltage and the main output voltage; and a fourth voltage divider, one end of the fourth voltage divider connected to the high-voltage end, another end of the fourth voltage divider connected to the upper end, and the fourth voltage divider generating the fourth output voltage to the fourth end according to the high voltage and the upper output voltage.

5. The multi-stage voltage division circuit according to claim 4, wherein the next-stage voltage division element further comprises a first switch set, a second switch set, a third switch set, and a fourth switch set, the first switch set connects to the two ends of the first voltage divider and the first end, the second switch set connects to the two ends of the second voltage divider and the second end, the third switch set connects to the two ends of the third voltage divider and the third end, the fourth switch set connects to the two ends of the fourth voltage divider and the fourth end, and the first switch set, the second switch set, the third switch set, and the fourth switch set are controlled by a control signal.

6. The multi-stage voltage division circuit according to claim 5, wherein the control signal is generated by a processor and the processor has a first clock and a second clock;

wherein when the first clock is high level and the second clock is low level, the processor controls the control signal to turn-on the first switch set and turn-off the second switch set, the third switch set, and the fourth switch set;

wherein when the first clock is high level and the second clock is high level, the processor controls the control signal to turn-on the second switch set and turn-off the first switch set, the third switch set, and the fourth switch set;

wherein when the first clock is low level and the second clock is low level, the processor controls the control signal to turn-on the third switch set and turn-off the first switch set, the second switch set, and the fourth switch set; and wherein when the first clock is low level and the second clock is high level, the processor controls the control signal to turn-on the fourth switch set and turn-off the first switch set, the second switch set, and the third switch set.

7. The multi-stage voltage division circuit according to claim 1, wherein the sub-stage voltage division element comprises:

a lower voltage divider, one end of the lower voltage divider connected to the main end, another end of the lower voltage divider connected to the low-voltage end, and the lower voltage divider generating the lower output voltage to the lower end according to the main output voltage and the low voltage; and an upper voltage divider, one end of the upper voltage divider connected to the high-voltage end, another end of the upper voltage divider connected to the main end, and the upper voltage divider generating the upper output voltage to the upper end according to the high voltage and the main output voltage.

8. The multi-stage voltage division circuit according to claim 7, wherein the sub-stage voltage division element further comprises a lower switch set and an upper switch set, the lower switch set connects to the two ends of the lower voltage divider and the lower end, the upper switch set connects to the two ends of the upper voltage divider and the upper end, and the lower switch set and the upper switch set are controlled by a control signal.

9. The multi-stage voltage division circuit according to claim 8, wherein the control signal is generated by a processor and the processor has a first clock;

wherein when the first clock is high level, the processor controls the control signal to turn-on the lower switch set and turn-off the upper switch set; and wherein when the first clock is low level, the processor controls the control signal to turn-off the lower switch set and turn-on the upper switch set.

10. The multi-stage voltage division circuit according to claim 1, further comprising three capacitors, one end of the three capacitors respectively connected to the lower end, the main end, and the upper end, and another end of the three capacitors connected to ground.

* * * * *